United States Patent [19]

Cappel, III

[11] Patent Number: 5,074,420

[45] Date of Patent: Dec. 24, 1991

[54] FREE-STANDING RACK ASSEMBLY

[76] Inventor: Joseph W. Cappel, III, 3801 Bellaire Cir., Fort Worth, Tex. 76109

[21] Appl. No.: 505,908

[22] Filed: Apr. 5, 1990

[51] Int. Cl.[5] ..... A47B 65/00

[52] U.S. Cl. ..... 211/42; 211/181

[58] Field of Search ..... 211/42, 40, 41, 184, 211/106, 181, 11

[56] References Cited

U.S. PATENT DOCUMENTS

| | | | |
|---|---|---|---|
| D. 180,955 | 9/1957 | Lyons | 211/40 X |
| D. 189,356 | 11/1960 | Kolkey . | |
| D. 223,616 | 5/1972 | Woods . | |
| 305,863 | 9/1884 | Thompson . | |
| 423,647 | 3/1890 | Wells . | |
| 428,555 | 5/1890 | Dom | 211/181 X |
| 660,264 | 10/1900 | Storm . | |
| 724,252 | 3/1903 | Blackwood | 211/181 X |
| 898,828 | 9/1908 | Brown | 211/181 X |
| 903,769 | 11/1908 | Poindexter . | |
| 1,277,827 | 9/1918 | Barber . | |
| 2,538,908 | 1/1951 | McKeehan . | |
| 2,889,054 | 6/1959 | Wheeler | 211/181 X |
| 2,986,315 | 5/1961 | Zimmerman . | |
| 3,114,459 | 12/1963 | Kersting . | |
| 3,176,849 | 4/1965 | Peebles | 211/181 X |
| 3,269,547 | 8/1966 | Chamberlin . | |
| 3,285,429 | 11/1966 | Probst . | |
| 3,308,964 | 3/1967 | Pistone . | |
| 3,358,956 | 12/1967 | Thornton . | |
| 3,601,258 | 8/1971 | Stein . | |
| 3,703,964 | 11/1972 | Field . | |
| 3,739,918 | 6/1973 | Kreitzburg . | |
| 3,780,876 | 12/1973 | Elkins . | |
| 3,800,958 | 4/1974 | Dorn . | |
| 4,327,838 | 5/1982 | Cooke . | |
| 4,782,960 | 11/1988 | Mavrakis . | |

*Primary Examiner*—David M. Purol

*Attorney, Agent, or Firm*—Randall C. Brown

[57] ABSTRACT

A free-standing rack assembly including a plurality of dividers which is useful for supporting books, charts, files, or the like. The assembly may be placed upon an open shelf or cabinet with the shelf or cabinet bearing the weight of the supported items and the rack assembly maintaining the supported items in an upright manner.

18 Claims, 2 Drawing Sheets

FREE-STANDING RACK ASSEMBLY

BACKGROUND OF THE INVENTION

1. Field of the Invention

The present invention relates generally to a free standing rack assembly for shelves, cabinets and the like. The free standing rack assembly has utility for supporting books, files, charts and the like in an upright manner.

2. Description of the Prior Art

Several divider devices for shelves, filing cabinets, and the like have been proposed in the prior art. For instance, U.S. Pat. No. 4,782,960 to Mavrakis discloses an adjustable shelf divider formed of spring wire. An engagement portion of the divider registers with a notch formed in a shelf so that the engagement portion of the divider sits flush with the shelf.

In addition, U.S. Pat. No. 3,601,258 to Stein discloses a bookend for use with open end shelves. The bookend is formed from a single strip of material in a generally triangular shape with a U-shaped base.

Moreover, U.S. Pat. No. 305,863 discloses a book support for holding books upright on the shelves of a bookcase when the shelves are not filled with books.

Other representative devices that are characteristic of the prior art are disclosed in U.S. Pat. Nos. 4,327,838; 3,800,958; 3,780,876; 3,739,918; 3,703,964; 3,308,964; 3,285,429; 3,269,547; 3,114,459; 2,538,908; 903,769; 660,264; 423,647; Des. 223,616; and Des. 189,356.

While the various devices disclosed in the above-mentioned patents may be effective for maintaining books, files, charts and the like in an upright manner on a shelf or in a cabinet, none of the patents show a free-standing rack assembly adapted to rest on a shelf or open cabinet which rack supports books, files, charts and the like and provides for the uniform insertion of such items with respect to the rack.

SUMMARY OF THE INVENTION

The free-standing rack assembly of the present invention avoids the above-mentioned disadvantages which are characteristic of the prior art. The free standing rack assembly of the present invention is useful for supporting books, files, charts, and the like in an upright manner and is especially useful in supporting charts or files in a large filing system, which charts or files must be retrieved quickly and easily on a daily basis, such as in a doctor s or dentist's office. The free-standing rack assembly of the present invention is adapted to rest on a shelf or open cabinet and support books, charts, files and the like while providing for the uniform insertion of such items with respect to the rack.

The free-standing rack assembly of the present invention comprises a plurality of divider means having a first end and a second end, first base means connected to the first end of each divider means, second base means connected to the second end of each divider means, and support means connected to each divider means at a point intermediate of the first end and the second end of the divider means.

In a preferred embodiment, the divider means extend parallel to each other, and the first base means, second base means and support mean extend parallel to each other and perpendicular to the divider means.

In another preferred embodiment, each divider means defines a plane, which planes extend in a parallel orientation, and the second base means and the support means define a plane that is perpendicular to the plane of each divider means.

BRIEF DESCRIPTION OF THE DRAWINGS

In describing the invention, reference will be made to the accompanying drawings in which.

DETAILED DESCRIPTION

Figures 1, 2:
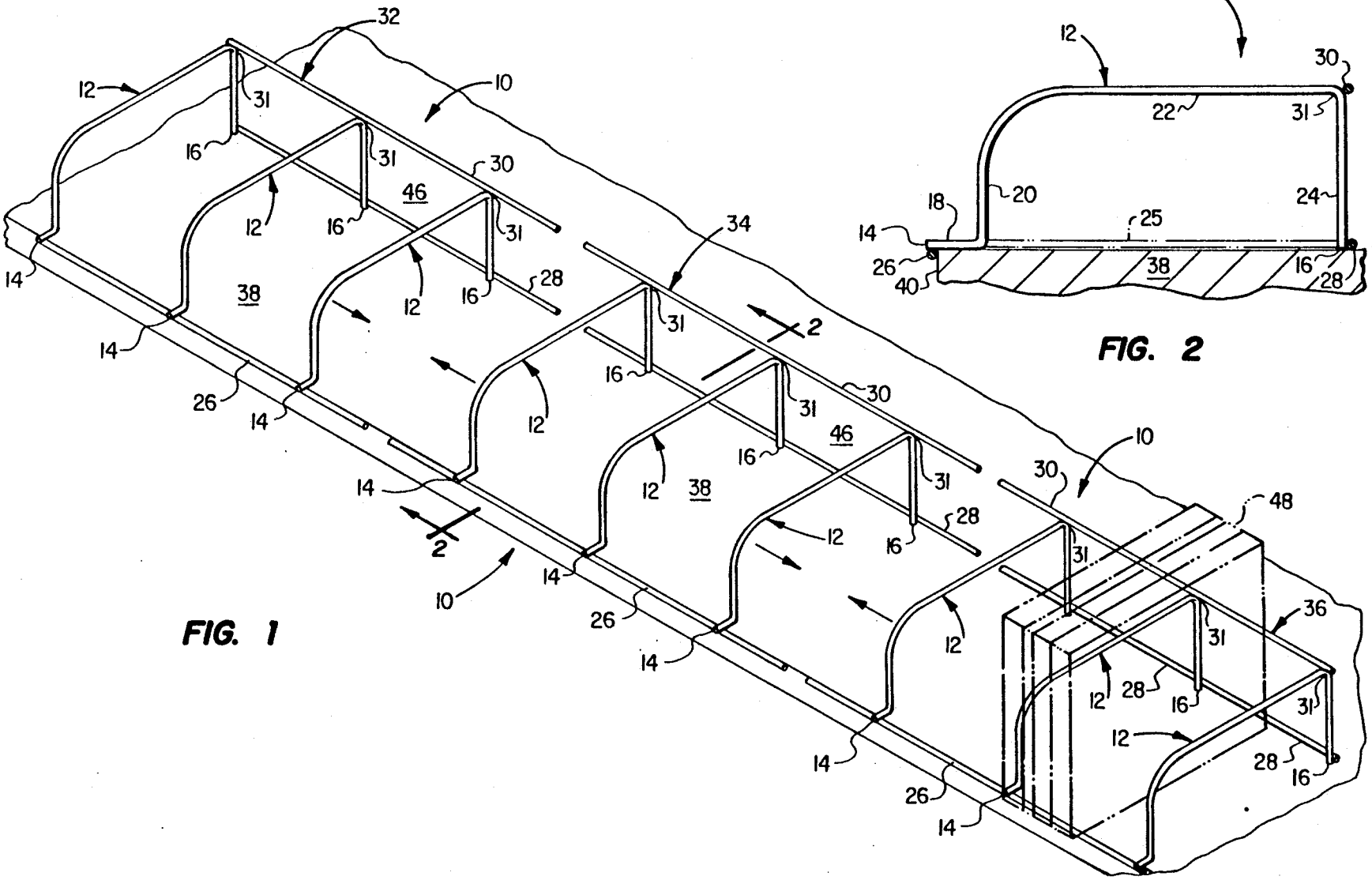
FIG. 1 is a perspective view of the free-standing rack assembly of the present invention.
FIG. 2 is a section taken along line 2–2 of FIG. 1 showing one application for the free-standing rack assembly of the present invention.

Referring now to the drawings, and in particular FIG. 1, a preferred embodiment of the free-standing rack assembly of the present invention is generally indicated at 10. The free-standing rack assembly 10 includes a plurality of divider members 12. Each divider member 12 has a first end 14 and a second end 16. The divider members 12, preferably, are disposed in a parallel orientation.

As shown more clearly in FIG. 2, each divider member 12 includes a first horizontally extending portion 18 adjacent the first end 14, a first generally vertically extending portion 20 adjacent the first horizontally extending portion 18, a second generally horizontally extending portion 22 adjacent the first generally vertically extending portion 20, and a second generally vertically extending portion 24 adjacent the second generally horizontally extending portion 22 and adjacent the second end 16. In an alternate embodiment a stabilizing member 25 shown in phantom lines extends between the second end 16 and the corresponding first horizontally extending portion 18 of each divider member 12.

Referring back to FIG. 1, the free-standing rack assembly 10 includes a base member 26 which is connected to the first end 14 of each divider member 12. A base member 28 is connected to the second end 16 of each divider member 12 and extends parallel to the base member 26. In addition, the base member 26 and the base member 28 extend perpendicular to a plane defined by each divider member 12.

A support member 30 is connected to each divider member 12 at a point 31 that is intermediate of the first end 14 and the second end 16 thereof. As shown more clearly in FIG. 2, the support member 30 is connected to each divider member 12 at a point 31 which coincides with the juncture of the second generally horizontally extending portion 22 and the second generally vertically extending portion 24. Also, the support member 30 extends perpendicular to the plane of each divider member 12 and parallel to both the base member 26 and the base member 28. In addition, a plane defined by the support member 30 and the base member 28 extends perpendicular to the plane of each divider member 12. Moreover, the plane defined by the support member 30 and the base member 28 is perpendicular to a plane defined by the base member 28 and the first horizontally extending portion 18 of each divider member 12.

As shown in FIG. 2, the base member 26 is connected to the first end 14 of each divider member 12 so that the base member 26 is offset from the plane defined by the base member 28 and the first horizontally extending portion 18 of each divider member 12 by the thickness of the base member 26. In addition, a plane defined by the base member 26 and the base member 28 is disposed at an obtuse angle to the plane defined by the support member 30 and the base member 28.

Accordingly, and as shown in FIG. 2, when placed on a shelf 38 having a front edge 40, the base member 26 rests against the front edge 40 of the shelf 38 and the first horizontally extending portion 18 and second end 16 of each divider member 12, as well as the base member 28 rest upon the surface of the shelf 38. The base member 26 forms the leading edge of the free-standing rack assembly 10 and is flush with the level of the shelf 38. The base member 26 also forms a lip over the front edge 40 of the shelf 38. In this manner, the base member 26 does not interfere with the removal or insertion of items supported by the free standing rack assembly 10.

As shown more clearly in FIG. 1, the support member 30 and the base member 28 define a back 46 and serve to limit the degree to which a book or chart 48 (shown in phantom) can be inserted within the free-standing rack assembly 10. Since the base member 26 is flush with the level of the shelf 38, the shelf 38 entirely supports the weight of the supported items and the free-standing rack assembly 10 functions to maintain the supported items in an upright manner. By forming a lip over the front edge 40 of the shelf 38, the base member 26 prevents the free standing rack assembly 10 from being dislodged from its position on the shelf 38 when a book or chart 48 is forced against the back 46 defined by the support member 30 and the base member 28. Preferably, the books or charts 48 supported by the free-standing rack assembly 10 when forced against the back of the rack 10 extend beyond the front edge 40 of the shelf 38 and beyond the base member 26. In this manner, the weight of the supported books or charts 48 prevents the base member 26 from moving upwardly during use and dislodging the free-standing rack assembly 10 from its position on the shelf 38.

As shown in FIG. 1, the free-standing rack assembly 10 may be assembled to yield a left assembly 32, a middle assembly 34, and a right assembly 36. According to the left assembly 32, one end of the base member 26, the base member 28, and the support member 30 is flush with the divider member 12 disposed at the left end of the left assembly 32 while the other end of the base member 26, the base member 28, and the support member 30 extends beyond the divider member 12 disposed at the right end of the left assembly 32. According to the middle assembly 34, both ends of the base member 26, the base member 28 and the support member 30 extend beyond the divider member 12 located at either end of the middle assembly 34. According to the right assembly 36, one end of the base member 26, the base member 28, and support member 30 is flush with the divider member 12 disposed at the right end of the right assembly 36 while the other end of the base member 26, the base member 28, and the support member 30 extends beyond the divider member 12 disposed at the left end of the right assembly 36. In this manner, and as shown in FIG. 1, the free-standing rack assembly 10 is modularized and adapted for placement on shelves of varying length.

Figure 3:
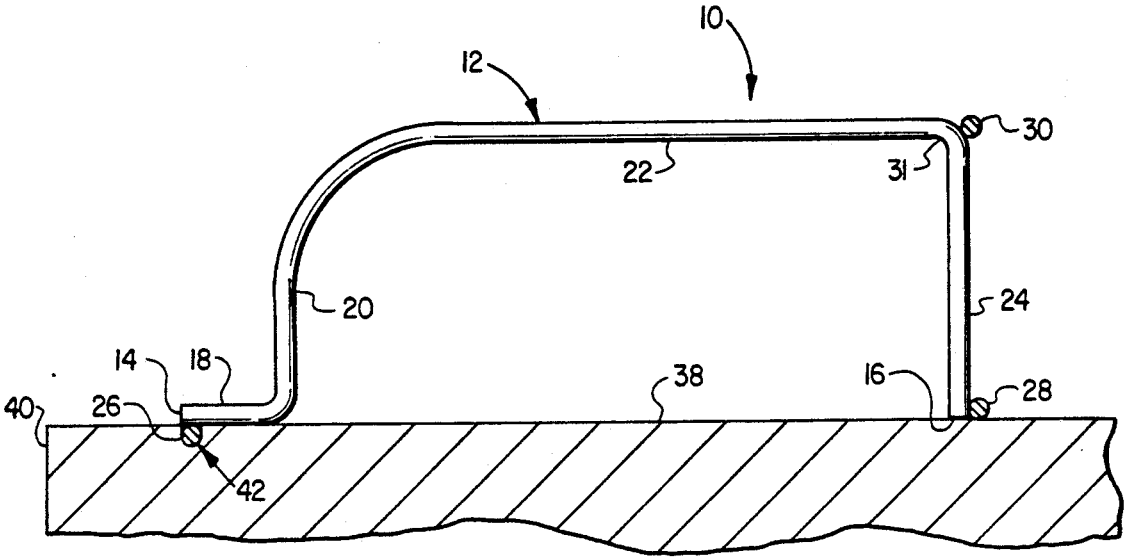
FIG. 3 is a side view of a second application for the free-standing rack assembly of the present invention.

As shown in FIG. 3, the free-standing rack assembly 10 may be used to support books, charts, files and the like on a shelf 38 having a groove 42 which registers with the base member 26. Preferably, the base member 26 is registered within groove 42 so that the base member 26 is flush with the surface of the shelf 38. In this manner, the first end 14 of each divider member 12 is recessed from the front edge 40 of the shelf 38. This arrangement makes the free standing rack assembly 10 particularly adapted for use in closable cabinets.

Figure 4:
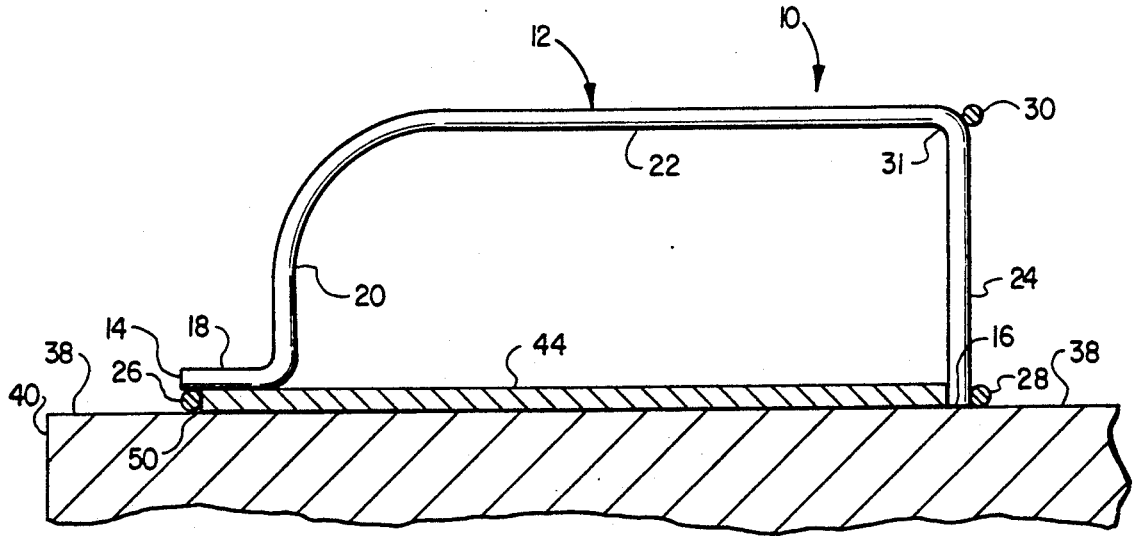
FIG. 4 is a side view of a third application of the free-standing rack assembly of the present invention.

As shown in FIG. 4 the free-standing rack assembly 10 is adapted for use on a shelf 38 which also supports a spacer 44. The spacer 44, preferably, has a thickness equal to the diameter or thickness of the base member 26. In addition, the spacer 44 has a width substantially equal to the distance between the base member 26 and the second end 16 of each divider member 12. In this manner, the shelf 38 is contacted by and supports the base member 26, the second end 16 of each divider member 12 and the base member 28. The books, files, charts or the like supported by the free-standing rack assembly 10 rest on the spacer 44. The base member 26 hangs over the front edge 50 of the spacer 44 to prevent the free-standing rack assembly 10 from moving in relation to the spacer 44 when books, files, charts or the like are inserted into the free-standing rack assembly 10 and against support member 30.

It will be recognized by those of ordinary skill in the art that in the various embodiments of the free-standing rack assembly 10 of the present invention, the divider members 12, the base member 26, the base member 28, the support member 30 and the stabilizing member 31 may be formed of any suitable rigid material including, but not limited to, metal wire stock, plastic or wood. For purposes of this application, the term rigid shall be understood to mean rigid and semi-rigid. It will also be recognized by those of ordinary skill in the art that in the various embodiments of the free-standing rack assembly 10 of the present invention, the divider members 12, the base member 26, the base member 28, the support member 30 and the stabilizing member 31 may be connected in the described manner by any conventional technique including, but not limited to, welding, brazing, gluing, soldering, and riveting. Finally, it will be recognized by those of ordinary skill in the art that the distance between the first horizontally extending portion 18 and the second end 16 of each divider member 12 may be varied so the free-standing rack assembly 10 may be adapted to support in an upright manner books, files, charts and the like of differing sizes.

While the present invention has been described in detail and with reference to specific examples thereof, it will be apparent to one skilled in the art that various changes and modifications can be made therein without departing from the spirit and scope thereof.

What is claimed is:

1. A free-standing rack assembly, comprising:

a) a plurality of divider means having a first end and a second end;

b) first base means connected to said first end of each said divider means;

c) second base means connected to said second end of each said divider means; and d) support means connected to each said divider means at a point intermediate of said first end and said second end, wherein each said divider means comprises a first generally vertically extending portion adjacent said first end and extending upwardly from said first base means, a first generally horizontally extending portion adjacent said first generally vertically extending portion, a second generally vertically extending portion adjacent said first generally horizontally extending portion, and a second horizontally extending portion adjacent said second generally vertically extending portion and said second end.

2. A free-standing rack assembly according to claim 1, wherein each said divider means comprises stabilizing means connected to said second horizontally extending portion and said first end.

3. A free-standing rack assembly according to claim 1, wherein each said divider means defines a plane and said planes extend parallel to each other.

4. A free-standing rack assembly according to claim 1, wherein said second base means extends parallel to said first base means.

5. A free-standing rack assembly according to claim 1, wherein each said divider means defines a plane and said first base means and said second base means extend perpendicular to said plane of each said divider means.

6. A free-standing rack assembly according to claim 1, wherein said support means extends parallel to said first base means and said second base means.

7. A free-standing rack assembly according to claim 1, wherein each said divider means defines a plane and said support means and said first base means define a plane, wherein said plane defined by said support means and said first base means extends perpendicular to the plane defined by each said divider means.

8. A free-standing rack assembly according to claim 1, wherein said support means is connected to each said divider means at the juncture of said first generally horizontally extending portion and said first generally vertically extending portion.

9. A free-standing rack assembly according to claim 8, wherein each said divider means defines a plane and said support means and said first base means define a plane, wherein said plane defined by said support means and said first base means extends perpendicular to the plane defined by each said divider means.

10. A free-standing rack assembly according to claim 1, wherein said support means and said first base means define a first plane and said first base means and said second horizontally extending portion of each said divider means define a second plane and wherein said first plane is perpendicular to said second plane.

11. A free-standing rack assembly according to claim 10, wherein said second base means is offset from said second plane by the thickness of said second base means and wherein said first base means and said second base means define a third plane and wherein said third plane is disposed at an obtuse angle to said first plane.

12. A free-standing rack assembly according to claim 1, wherein said plurality of divider means, said first base means, said second base means and said support means comprise a rigid material.

13. A free-standing rack assembly according to claim 1, wherein said plurality of divider means, said first base means, said second base means and said support means comprise a material selected from the group consisting of metal wire stock, plastic and wood.

14. A free-standing rack assembly according to claim 1, wherein said first base means, said second base means and said support means are connected to said divider means by a method selected from the group consisting of welding, brazing, gluing, soldering and riveting.

15. A free-standing rack assembly according to claim 1, wherein said second base means extends below a plane defined by said first base means and said second horizontally extending portion of each said divider means to enable said second base means to extend over an edge of a shelf while said first base means and said second horizontally extending portion of each said divider means rest on an upper surface of said shelf.

16. A free-standing rack assembly according to claim 15, wherein said shelf comprises a groove and said second base means registers with said groove.

17. A free-standing rack assembly according to claim 15, wherein a spacer member is disposed on said upper surface of said shelf and said second base means extends over an edge of said spacer member, said second horizontally extending portion of each said divider means rests on an upper surface of said spacer member and said first base means rests on said upper surface of said shelf.

18. A free-standing rack assembly, comprising:

a) a plurality of divider means, each said divider means having a first end, a first horizontally extending portion adjacent said first end, a first generally vertically extending portion adjacent said first horizontally extending portion, a second generally horizontally extending portion adjacent said first generally vertically extending portion, a second generally vertically extending portion adjacent said second generally horizontally extending portion and a second end adjacent said second generally vertically extending portion, each said divider means defining a plane and said planes extend parallel to each other;

b) first base means connected to said first end of each said divider means, said first base means extending perpendicular to said plane of each said divider means;

c) second base means connected to said second end of each said divider means, said second base means extending parallel to said first base means and perpendicular to said plane of each said divider means; and d) support means connected to each said divider means at the juncture of said second generally horizontally extending portion and said second generally vertically extending portion, said support means extending parallel to said first base means and said second base means;

wherein said support means and said second base means define a first plane, wherein said first plane extends perpendicular to the plane defined by each said divider means, wherein said second base means and said first horizontally extending portion of each said divider means define a second plane wherein said first plane is perpendicular to said second plane, and wherein said first base means is offset from said second plane by the thickness of said first base means and wherein said first base means and said second base means define a third plane wherein said third plane is disposed at an obtuse angle to said first plane.

* * * * *

UNITED STATES PATENT AND TRADEMARK OFFICE

CERTIFICATE OF CORRECTION

PATENT NO. : 5,074,420

DATED : December 24, 1991

INVENTOR(S) : Joseph W. Cappel, III

It is certified that error appears in the above-identified patent and that said Letters Patent is hereby corrected as shown below:

Column 1, lines 6 and 7, change "free standing" to -- free-standing --.

Column 1, line 8, change "free standing" to -- free-standing --.

Column 1, line 43, change "free standing" to -- free-standing --.

Column 1, line 49, change "doctor s" to -- doctor's --.

Column 1, line 64, change "mean" to -- means --.

Column 3, line 18, change "free standing" to -- free-standing --.

Column 3, line 29, change "free standing" to -- free-standing --.

Column 4, line 5, change "free standing" to -- free-standing --.

Column 4, line 33, change "cf" to -- of --.

Signed and Sealed this

Sixth Day of April, 1993

*Attest:*

STEPHEN G. KUNIN

*Attesting Officer*

*Acting Commissioner of Patents and Trademarks*